United States Patent [19]

Buckley et al.

[11] Patent Number: 4,596,112

[45] Date of Patent: Jun. 24, 1986

[54] CIGARETTE PACKING MACHINES

[75] Inventors: William M. Buckley; Robert H. Taylor, both of London, England

[73] Assignee: Molins PLC, London, England

[21] Appl. No.: 647,500

[22] Filed: Sep. 5, 1984

[30] Foreign Application Priority Data

Sep. 14, 1983 [GB] United Kingdom ..... 8324609

[51] Int. Cl.[4] ..... B65B 7/22

[52] U.S. Cl. ..... 53/476; 53/207; 53/234; 53/462; 53/579

[58] Field of Search ..... 53/53, 207, 449, 452, 53/456, 458, 462, 574, 578, 579, 234; 493/911

[56] References Cited

U.S. PATENT DOCUMENTS

| | | | |
|---|---|---|---|
| 3,956,865 | 5/1976 | Schmermund | 53/456 |
| 4,084,393 | 4/1978 | Focke | 53/207 |
| 4,144,695 | 3/1979 | Seragnoli | 53/234 |
| 4,208,854 | 6/1980 | Seragnoli | 53/207 |

FOREIGN PATENT DOCUMENTS

| | | | |
|---|---|---|---|
| 0082348 | 6/1983 | European Pat. Off. | 53/234 |
| 1429641 | 3/1976 | United Kingdom | 53/234 |

*Primary Examiner*—John Sipos
*Assistant Examiner*—Donald R. Studebaker
*Attorney, Agent, or Firm*—John C. Smith, Jr.

[57] ABSTRACT

A machine for packing groups or bundles of cigarettes has a packing conveyor 15 on which each wrapped bundle 32 is laterally supported within an outer blank by corner tabs 12 of the blank being reverse folded at a station C before an inner frame 38 is inserted. The tabs 12 subsequently slide along a raised track 28, which extends up to a station G where the inner frame is applied, so that the inner wall 11 of the lid is kept upright. At a downstream station N is a rejector device for faulty packs, including a continuously reciprocating pusher 50 which is swung down into its operative position by a rib cam 76. One of the cam followers 80 is brought into contact with the cam during its dwell portion 77 by operating an actuator 88 to extend and align a pair of toggle links 84, 86.

8 Claims, 5 Drawing Figures

CIGARETTE PACKING MACHINES

Figure 1:
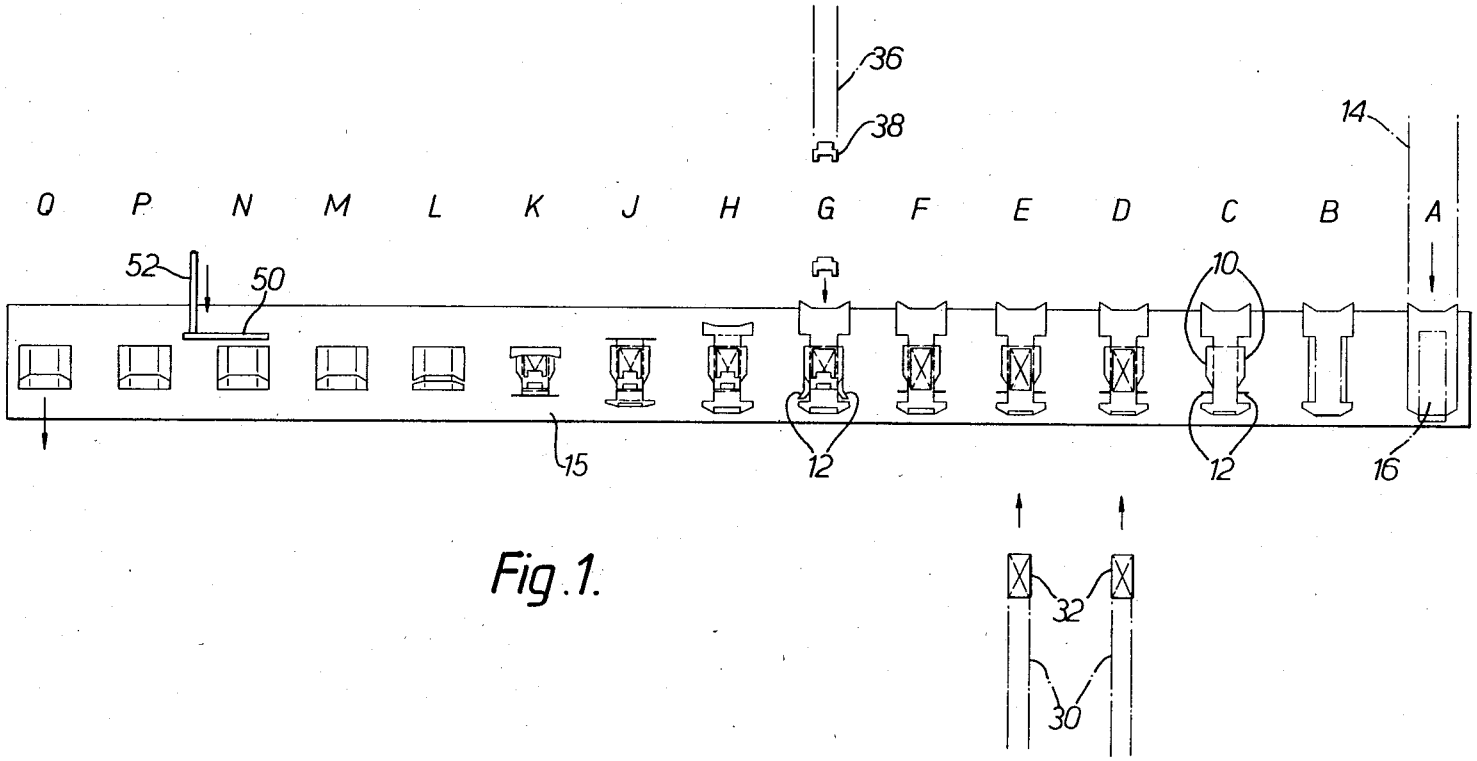

This invention is concerned with the packing of groups or bundles of cigarettes in packets, more particularly in hinged lid packets.

Machines for packing cigarettes at present invariably operate in intermittent cycles, as distinct from continuously. The cigarette groups may indeed be wrapped in their conventional aluminum foil inner wrappings along a continuously moving bundle conveyor but the packing conveyor on which the outer blanks are formed about the wrapped bundles still operates intermittently, as for example on the Molins HLP4 hinged lid packing machine.

In the continuing quest for packing machines with higher rates of output, a machine layout has been proposed for a hinged lid packer in which two conveyors feed two tracks of cigarette bundles into a single intermittent packing conveyor. A problem with such a layout concerns the collar blanks or inner frames which make up part of the inner front of the packet and which have hitherto been applied to the bundles before they are inserted into the main or outer blanks. Since such inner frames are cut from continuous strip material, and as it is ususal to have a waiting reel to replace an expiring running reel in order to reduce the downtime of the machine, this would mean that provision for four reels of inner frame material would need to be made, which would occupy an exorbitant amount of space on the machine.

With the high outputs contemplated by the proposed machine layout, which may operate at speeds of 400 packets per minute or higher, it is also a problem to provide a rejection device which can be brought into operation rapidly enough to cope with such high speeds.

According to one aspect of the invention there is provided a method of packing a succession of groups of cigarettes into packets, each group having two sides and two large faces and each packet having an outer blank with a large face and two side flaps and an inner blank extendable around two sides and one large face of a respective group, comprising the steps of folding the side flaps of each outer blank substantially perpendicular to its large face, inserting a group of cigarettes into each folded outer blank, momentarily releasing the side flaps from their perpendicular folded positions while applying a folded inner blank on to the group within the side flaps, and completing the formation of the packet.

The invention also provides apparatus for packing groups of cigarettes in packets consisting each of an inner blank and an outer blank, comprising a packing conveyor having a regular succesion of pockets thereon each for supporting an outer blank, a pair of group conveyors each for supplying a group on to an outer blank on alternate pockets, feed means downstream of the group conveyors for feeding an inner blank on to each group, and means disposed along the packing conveyor for forming each outer blank around the bundle and inner blank thereon.

The packing conveyor may be driven intermittently along a linear path. Preferably there is provided a flap control means for holding upright the side flaps, comprising a guide track extending parallel to the packing conveyor, and means for outwardly reverse folding the corner tabs into a position parallel to the conveyor so that their lower edges rest on the track and maintain the side flaps upright. Said release means may then comprise two cut-away portions formed in the guide track to allow the side flaps to be released.

According to another aspect of the invention there is provided in apparatus for packing bundles of cigarettes in packets, a device for rejecting faulty packets, comprising continuously reciprocating pusher whose working stroke is in phase with the dwell period between the intermittent movement of a succession of packets, and cam means selectively operable to bring the reciprocating pusher into line with a packet to be rejected.

The cam means may comprise a continuously driven cam and a cam follower connected with a support for the reciprocating pusher and movable into contact with the cam during a dwell period thereof. Preferably the pusher is mounted on an arm and the pusher support is pivotable, so that the pusher moves about an arcuate path between an operative and an inoperative position. The cam may be a rib cam, with said cam follower being movable by a toggle mechanism towards a second cam follower on the opposite side of the rib cam.

Figure 2:
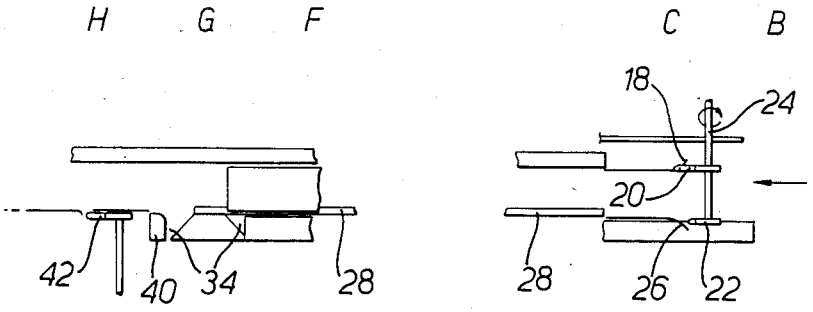
Figure 3:
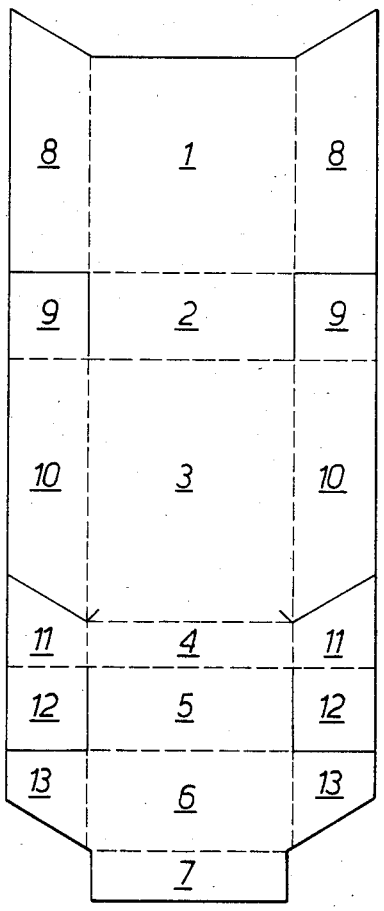
Figure 4:
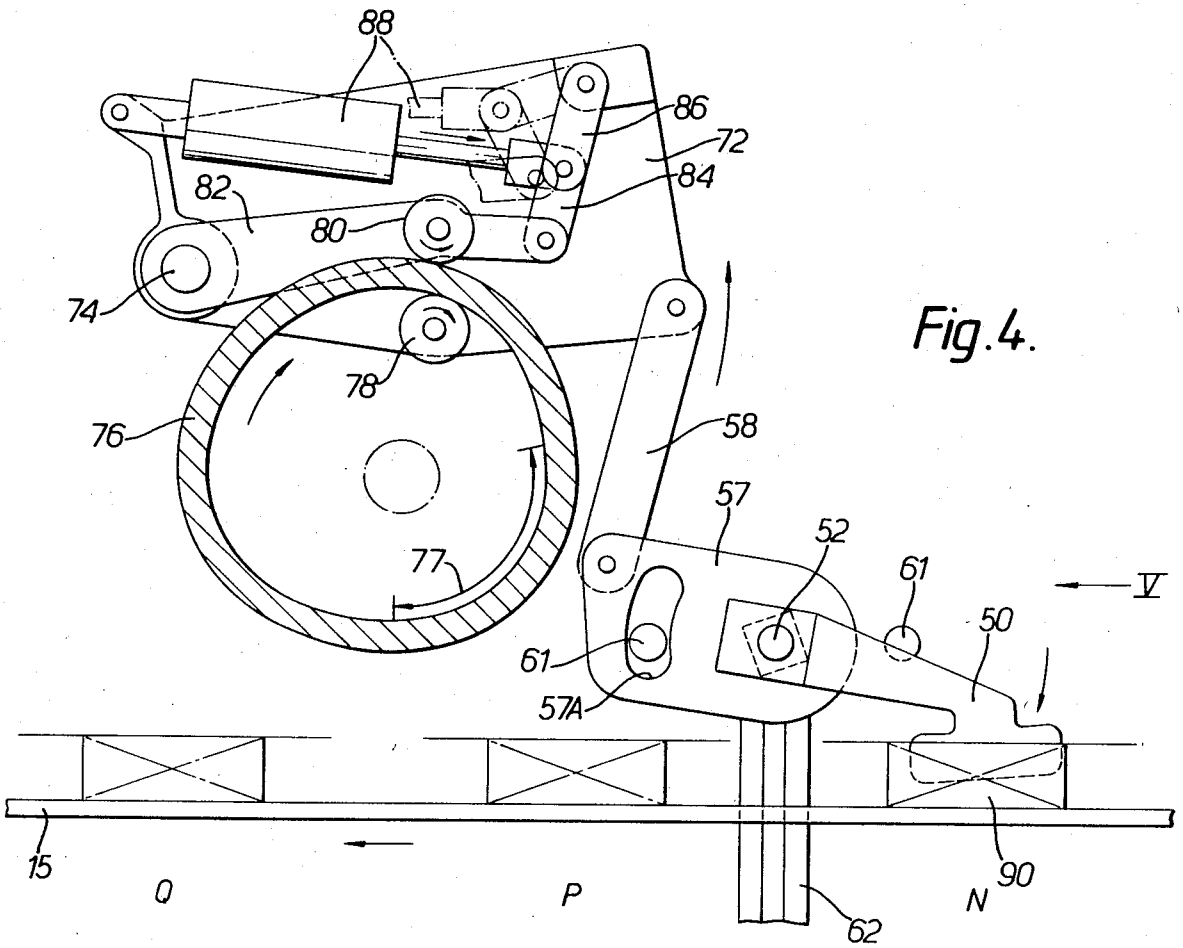
Figure 5:
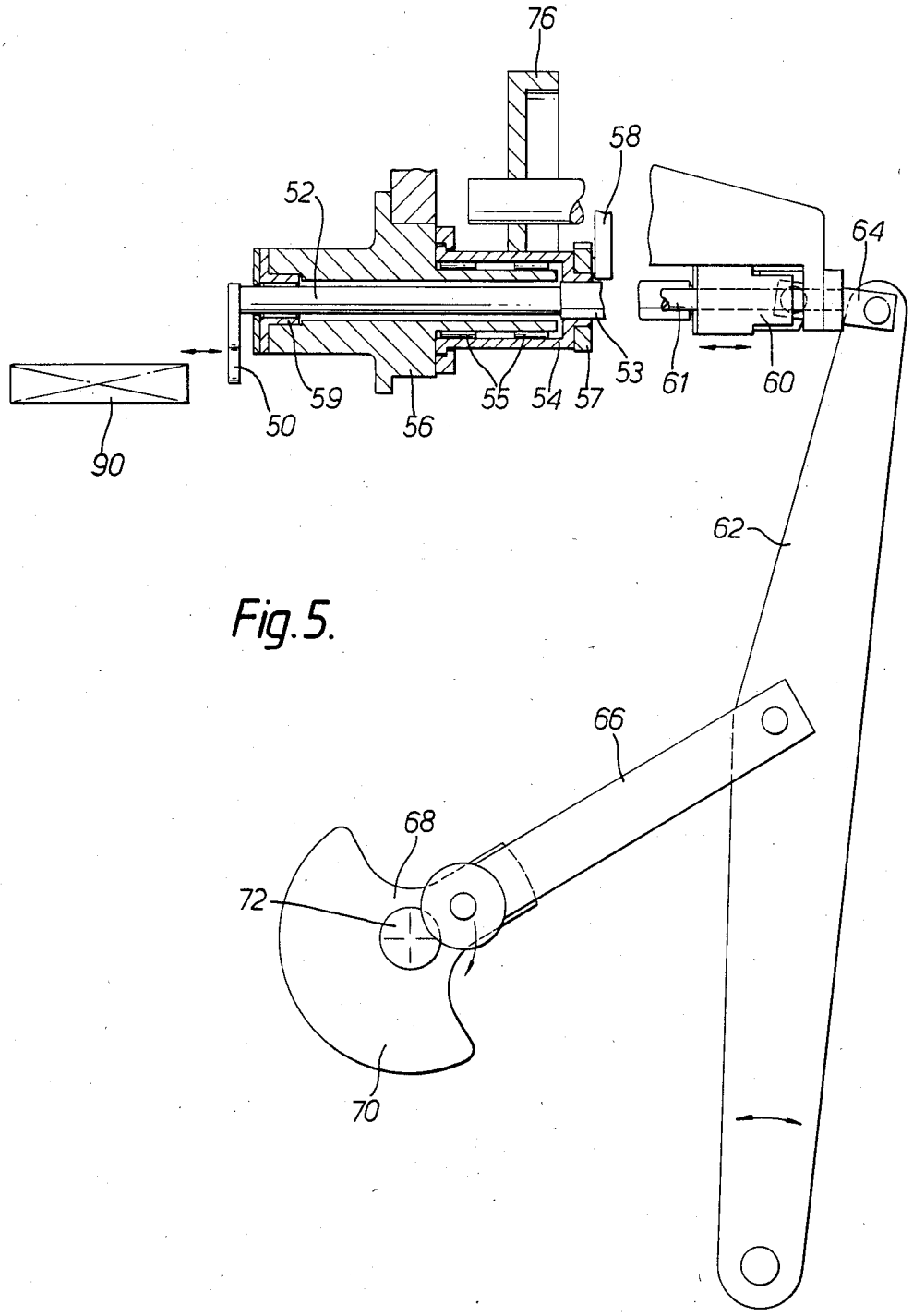

The invention will now be described, by way of example only, with reference to the accompanying drawings in which:

FIG. 1 is a plan view essentially of the material flow path on a packing machine embodying the invention, FIG. 2 are details in plan view of parts of the machine corresponding to FIG. 1, FIG. 3 shows an outer blank from which a hinged lid packet is formed, FIG. 4 is a front view of a packet rejection device, and FIG. 5 is a side view, on a smaller scale and partly in section, of the rejection device.

Referring first to FIG. 1, there are shown in plan a plurality of stations, indicated by the reference letters A to Q, along which a succession of hinged lid outer blanks are intermittently fed by a packing conveyor 15, sometimes known as a sealer bed conveyor, and then formed around cigarette bundles into hinged lid packets.

One of the blanks is shown in FIG. 3 on an enlarged scale. The blank may conveniently be considered as having a body portion and a lid portion connected by a hinge line to the body portion. Starting from the top of the figure, the panels at the centre of the blank in sequence are: a front wall 1, a base 2 and a rear wall 3, all for the body portion; and a shorter rear wall 4 connected to the rear wall by the hinge line, a top 5, a front wall 6 and a lid reinforcement 7, all for the lid portion. At each side of these central parts there is, again in sequence: an outer side wall 8, a bottom corner tab 9 and an inner side wall 10, all for the body portion; and inner wall 11, a top corner tab 12 and an outer side wall 13, all for the lid portion.

At station A (FIG. 1) a succession of flat outer blanks are fed along a blank conveyor 14 to a position where a vertical plunger 16 operates on all of the central panels 2 to 6 of each successive blank to bring the bottom corner tabs 9, the inner side walls 10 and 11, and the top corner tabs 12 into an upright position at an angle of approximately 15 degrees outward from the vertical. At the same time the reinforcement panel 7 is brought into a vertical position at station A. The packing conveyor 15 is provided with a series of regularly spaced plastic pockets (not shown), with one pocket being positioned at each station at any one time. The inner side walls 10 are engaged and held in the plastic pocket by small lips at the top of the side walls of the pocket.

Referring now additionally to FIG. 2, between stations B anc C there is a fixed plough 18 which engages the leading bottom corner tab 9 (i.e. the one shown to the left in FIG. 3) to fold it inwards into a vertical plane. Also between stations B and C are a pair of chasing tuckers 20 and 22 mounted on a constantly rotating common shaft 24. The tucker 22 engages the leading top corner tab 12, to fold it outwards into a vertical plane, so that it is held there by an extension to the left of a corresponding fixed plough 26. As the blank advances further to station C the chasing tucker 20 folds the trailing bottom corner tab 9 inwards into a vertical plane, where it is similarly held by an extension of the plough 18. Conversley the trailing top corner tab 12 is folded outwards into a vertical plane by the plough 26.

The lower edges of both the top corner tabs 12, i.e. the edges which were previously adjacent to the top panel 5, now slide onto a continuous guide track 28 which raises these edges into a horizontal position so that the inner side walls 11 of the lid position are also brought into a substantially vertical position, as shown at station C.

During the next two indexing movements of the pockets on the packing conveyor 15 to stations D and E no operations are performed on the blank. At stations D and E the blanks are aligned with a pair of parallel filler or bundle conveyors 30, the distance or spacing between which corresponds to the pitch between pockets and between stations. The filler conveyors 30 are timed to feed a group or bundle of cigarettes enclosed in a foil wrapper into each respective blank, in that at each alternate indexing movement of the packing conveyor a pair of bundles are delivered by the filler conveyors 30 to the packing conveyor 15.

The bundles 32 do not yet have inner frames on them when fed into the partly formed blanks, so there is sufficient clearance for their entry between the vertical inner side walls 11.

As a blank is moved by the packing conveyor to station G (station F being for this purpose idle) the level of the guide rail 28 drops and the top corner tabs 12 enter into shaped cut-out portions 34 formed in the extension of the plough 26. As can be seen in FIG. 1, this enables the corner tabs 12 to relax into a position in which the inner side walls 11 of the lid position also fall back to a position parallel to the inner side walls 10 of the body position, i.e. at about 15 degrees from the vertical.

Station G is aligned with a further conveyor 36 along which are fed inner frames 38, each having its side wings already folded down into an inverted U shape. When an inner frame 38 is in position over a bundle 32 it is vertically lowered onto the bundle so that its two wings enter between the inner side walls 11 and the sides of the bundles.

In moving to station H the leading corner flap 12 engages another fixed plough 40 (FIG. 2) which folds it inwards against the top end face of the bundle. Downstream of the plough 40 is a chasing tucker 42 which engages the trailing corner tab 12 and similarly folds it inwards against the bundle so that it is held in that position by an extension to the left of the plough 40.

The front wall 1 and the base 2 of the body portion start to be folded from station H onwards, so that by station M the centre panels of the body portion rest on the bundle. Similarly the lid portion (whose reinforcement 7 is folded and secured flat at station F, adhesive having previously been applied) starts to be folded around the top of the bundle commencing from statin J, so that likewise at station M the top 5 and front wall 6 of the lid portion rest on the bundle.

If any fault has been detected in a packet by any of the various detectors positioned upstream of the station N, then the packet is rejected at this station by a mechanism to be described below. Finally, at station Q the almost fully formed packet is transferred out of the packing conveyor for adhesive to be applied to the outer walls 8 and 13, and the packet is then transferred into a drying drum of known construction (not shown) where its formation is completed.

It will be seen from the foregoing description that by utilising the top corner flaps 13 to hold the inner side walls 11 of the lid portion upright, it is ensured that the top end of the cigarette bundle is laterally located at each side, thereby preventing any undue movement of the cigarettes within the foil wrapped bundle caused by the high speed intermittent movement of the packing conveyor.

Reference will now be made to FIGS. 4 and 5 which show the rejection device for removing faulty packets at station N.

A rejection pusher 50 is pivotally supported on a reciprocable spindle 52. The central part 53 of the spindle is of square section and slides in a member 54 having a corresponding square aperture. The member 54 is rotatable about the axis of the spindle 52 by being supported on needle bearings 55 mounted upon a fixed housing 56. Secured to the member 54 is a plate 57 to one end of which is pivotally connected a driving link 58.

The housing 56 also supports a circular journal bearing 59 in which the free end of the spindle 52, adjacent the pusher 50, is rotably and axially slidable. The other end of the spindle 52, to the right of the central square section 53 as viewed in FIG. 5, is secured to a cross-piece 60 which is slidably mounted on a pair of fixed guide rods 61. The plate 57 is provided with an arcuate clearance slot 57A (FIG. 4) to accommodate one of the rods 61 which passes through it.

The spindle 52, and thus the pusher 50 at its free end, are continuously reciprocated by a beam 62 whose free upper end is connected by a link 64 to the right-hand end of the spindle 52, as viewed in FIG. 5. A connecting rod 66, pivotally connected towards the middle of the beam 62, osillates it by means of a crank 68 having a counter balance 70 at its opposite end and rotatable about a shaft 72.

Referring again to FIG. 4, movement is imparted to the link 58 via a drive plate 72 pivotal about a pin 74 by means of a rib cam 76 continuously rotable in a clockwise direction. The plate 72 carries an inner cam follower roller 78, and an outer cam follower roller 80 is carried on an arm 82 which is pivotal also about the pin 74. The free end of the arm 82 is pivotally connected by a pair of toggle links 84 and 86 to the opposite corner of the drive plate 72. Acting on the pivotal connection between the toggle links 84 and 86 is one end of a solenoid actuated ram 88, whose other end is connected to the remaining corner the plate 72.

The operation of the rejection device will now be described.

Commencing with the ram 88 retracted (as partly shown chain-dotted) and the pusher 50 raised, a rejection signal is received from a known memory device, which stores information about faulty packets and forms part of the packing machine. When the pusher 50 is in its retracted position, to the left as shown in FIG. 5, the ram 88 is selectively actuated via the memory device; the timing being such that the rib cam 76 then has its minimum radius dwell portion 77 adjacent to the inner cam roller 78. The toggle links 84 and 86 are thus moved from their chain-dotted position into the full line position in which they are axially aligned, thereby pivoting the arm 82 downwards and bringing both cam rollers 80 and 78 into engagement with the cam 76. Rotation of the cam 76 then commences to pivot the plate 72 in an anticlockwise direction, moving the link 60 upwards and causing the pusher 50 to decend into line with a packet 90 to be rejected, as shown in FIG. 5.

The pusher 50 reaches its lower-most operative position well before it engages the packet 90, so that it engages fully behind it to reject it out of its plastic pocket on the packing conveyor 15. At the end of the working stroke of the pusher 50 the cam rollers 78 and 80 have again reached the minimum radius portion 77 of the cam 76, and at this moment the ram 88 is arranged to retract, thereby bringing the outer roller 80 out of engagement with the cam so that the pusher 50 remains in its uppermost position.

The rejection device described enables a very rapid pivotal movement of the pusher 50 to be effected with a minimum of inertia, at the high operating speed of the packing machine.

We claim:

1. A method of packing a succession of groups of cigarettes into packets, each group having two sides and two large faces and each packet having an outer blank with a large face and two side flaps and an inner blank extendable around two sides and one large face of a respective group, comprising the steps of folding the side flaps of each outer blank substantially perpendicular to its large face, inserting a group of cigarettes into each folded outer blank, momentarily releasing the side flaps from their perpendicular folded positions while applying a folded inner blank onto the group between the side flaps and said sides of said group, and completing the formation of the packet.

2. Apparatus for packing groups of cigarettes in packets consisting each of an inner blank having a pair of wings and an outer blank having a pair of side flaps to overlap said wings, respectively, on said inner flap, comprising a packing conveyor having a regular succession of pockets thereon each for supporting an outer blank, a pair of group conveyors each for supplying a group onto an outer blank on alternate pockets, flap control means for normally holding said side flaps upright, feed means downstream of the group of conveyors for feeding an inner blank onto each group with said pair of wings on said inner blank extending downwardly, said flap control means being adapted to release said side flaps while said feed means operates such that said pair of wings of said inner blank extend downwardly between respective side flaps of said outer blank and said bundle, and means disposed along the packing conveyor for forming each outer blank around the bundle and inner blank thereon.

3. Apparatus for packing groups of cigarettes in hinged lid packets each consisting of an inner blank extendable around opposite sides of a group and an outer blank having side flaps engageable against the inner blank at said opposite sides, comprising (a) a packing conveyor provided with regularly spaced pockets each for supporting an outer blank with said side flaps folded, (b) supply means for supplying a group of cigarettes onto an outer blank on successive pockets of said packing conveyor, (c) feed means downstream of said supply means for feeding an inner blank on to each group between said side flaps and said opposite sides of said group, and (d) flap control means for releasing said flaps of each outer blank momentarily while said feed means operates.

4. Apparatus as claimed in claim 3, in which said supply means comprises a pair of group conveyors disposed perpendicular to the packing conveyor and in which the packing conveyor is intermittently movable in steps corresponding to the spacing between adjacent pockets.

5. Apparatus as claimed in claim 4 and further comprising a packet rejection device downstream of said feed means, including a continuously reciprocating pusher whose working stroke is in phase with the stationary period between intermittent movements of the packing conveyor, and cam means selectively operable to bring the pusher into line with a packet to be rejected.

6. Apparatus as claimed in claim 5 in which the cam means comprises a continuously driven cam and a cam follower operably connected with the reciprocating pusher and engageable with the cam during a dwell period thereof.

7. Apparatus as claimed in claim 3 in which the operating run of the packing conveyor is linear.

8. Apparatus as claimed in claim 3 wherein each said side flap of the outer blank has a corner tab attached thereto, and in which the flap control means further comprises means for reverse folding the corner tabs parallel to the direction of movement of the packing conveyor.

* * * * *